US010343884B2

(12) United States Patent
Roberts et al.

(10) Patent No.: US 10,343,884 B2
(45) Date of Patent: Jul. 9, 2019

(54) SYSTEM AND METHOD FOR DISPENSING A BEVERAGE

(71) Applicant: E. & J. Gallo Winery, Modesto, CA (US)

(72) Inventors: Kimberly Roberts, San Francisco, CA (US); Patrick Coyle, Modesto, CA (US); Alexander Coriano, III, Brisbane, CA (US); Vivian K. Barad, San Francisco, CA (US); Thomas Dieter Christian-Overthun, San Francisco, CA (US); David Jason Wilkins, San Francisco, CA (US); Anthony Peter Patron, Mountain View, CA (US); Eben Roy Sargent, Seattle, WA (US); Daniel Lawrence Evans, Oakland, CA (US)

( * ) Notice: Subject to any disclaimer, the term of this patent is extended or adjusted under 35 U.S.C. 154(b) by 0 days.

(21) Appl. No.: 15/205,987

(22) Filed: Jul. 8, 2016

(65) Prior Publication Data

US 2017/0008746 A1 Jan. 12, 2017

Related U.S. Application Data

(60) Provisional application No. 62/191,201, filed on Jul. 10, 2015.

(51) Int. Cl.
*B67D 1/00* (2006.01)
*B67D 1/08* (2006.01)
(Continued)

(52) U.S. Cl.
CPC ..... *B67D 1/0001* (2013.01); *B67D 1/0004* (2013.01); *B67D 1/0801* (2013.01);
(Continued)

(58) Field of Classification Search
CPC .. B67D 1/0001; B67D 1/0004; B67D 1/0801; B67D 2001/0827; B67D 3/0067;
(Continued)

(56) References Cited

U.S. PATENT DOCUMENTS

D199,408 S 10/1964 Felske
3,173,579 A * 3/1965 Curie ..... B65D 47/283 222/105
(Continued)

FOREIGN PATENT DOCUMENTS

EP 0648838 4/1995
JP H07281242 10/1995
(Continued)

OTHER PUBLICATIONS

Mpls St Paul. Wine to Go? Gel It in the Box. Apr. 1, 2013 [earliest online date], [site visited Oct. 19, 2016]. Available from Internet, <URL:http://mspmag.com/eat-and-drink/wine-to-go-get-it-in-the-box/>.
(Continued)

*Primary Examiner* — Nicholas J. Weiss
(74) *Attorney, Agent, or Firm* — Goodwin Procter LLP

(57) ABSTRACT

A system and method for dispensing a beverage. The system includes a beverage cartridge that stores any liquid and has a spout for dispensing the stored liquid. The beverage cartridge may be inserted into a beverage press that includes a housing for receiving the beverage cartridge. The beverage press also includes a tap that engages the spout of the beverage cartridge, and a lifting assembly that exerts force on the beverage cartridge. Pressing the tap activates the spout of the beverage cartridge to dispense the stored liquid through the spout and out of the tap of the beverage press, a system for dispensing a beverage.

14 Claims, 13 Drawing Sheets

(51) Int. Cl.
*B67D 1/14* (2006.01)
*B67D 3/00* (2006.01)

(52) U.S. Cl.
CPC ..... *B67D 3/0029* (2013.01); *B67D 3/0067* (2013.01); *B67D 1/1477* (2013.01); *B67D 2001/0827* (2013.01)

(58) Field of Classification Search
CPC ..... B65D 83/0005; B65D 83/0038; B65D 83/0072; B65D 83/0077
See application file for complete search history.

(56) References Cited

U.S. PATENT DOCUMENTS

D244,529 S 5/1977 Gomez
D274,685 S 7/1984 Ohmoto
D320,735 S 10/1991 Pettengill
5,096,092 A * 3/1992 Devine ..... B67D 1/0462 222/105
D356,713 S 3/1995 Groover
D361,242 S 8/1995 Baroudi
D373,529 S 9/1996 Zogg
5,775,364 A * 7/1998 Erb ..... B67D 3/043 137/322
D396,588 S 8/1998 Mack
D402,193 S 12/1998 Bell
D408,209 S 4/1999 Bhumra
6,062,426 A * 5/2000 Bartholmey ..... A23G 9/045 222/1
6,119,884 A * 9/2000 Lowry ..... B65D 83/0072 220/495.03
6,126,046 A * 10/2000 Baculy ..... B67D 3/043 222/505
D440,867 S 4/2001 Dailey
D482,229 S 11/2003 Beveridge
D486,347 S 2/2004 Meike
D518,677 S 4/2006 Van Berlo
7,076,966 B2 * 7/2006 Mullen ..... B67D 3/0009 222/132
D593,353 S 6/2009 Hoffman
D640,891 S 7/2011 Smith
D648,971 S 11/2011 Goralski
D674,636 S 1/2013 Yang
D676,701 S 2/2013 Chung
D690,131 S 9/2013 Clough
8,556,124 B2 10/2013 Edwards
8,567,645 B1 * 10/2013 Orr ..... B67D 3/04 222/105
D696,887 S 1/2014 Minica
D699,047 S 2/2014 Lissoni
D701,411 S 3/2014 Stacks
8,763,857 B2 * 7/2014 Middleton ..... B65D 83/0077 222/103
8,777,059 B2 * 7/2014 Middleton ..... B67D 3/00 222/103
D711,178 S 8/2014 Waugh
8,800,814 B2 * 8/2014 Braun ..... B67D 3/0009 222/105
8,820,094 B1 * 9/2014 Casher ..... B67D 3/0054 62/3.2
D718,573 S 12/2014 De Pra
D727,653 S 4/2015 Bjerre-Poulsen
9,016,555 B2 * 4/2015 Plunkett ..... B65D 77/065 220/666
9,056,759 B2 * 6/2015 Hourmand ..... B67D 1/1405
D742,156 S 11/2015 Harris
D755,629 S 5/2016 Marraccini
D756,215 S 5/2016 Noguchi
D763,613 S 8/2016 Han
D763,619 S 8/2016 Girardi
9,546,086 B2 * 1/2017 Samson ..... B65D 77/067
D788,585 S * 6/2017 Roberts ..... D9/456
D789,131 S * 6/2017 Roberts ..... D23/255
D789,132 S * 6/2017 Roberts ..... D6/542
D795,628 S * 8/2017 Roberts ..... D6/542
D796,243 S * 9/2017 Roberts ..... D7/313
2007/0211967 A1 9/2007 Murray
2008/0264947 A1 10/2008 Morenstein
2009/0120956 A1 * 5/2009 De La Fe Dahlin .. B65D 77/06 222/95
2010/0133298 A1 6/2010 Samson
2012/0104041 A1 5/2012 Coleman
2013/0240562 A1 9/2013 Middleton

FOREIGN PATENT DOCUMENTS

JP H09235300 9/1997
JP 2002226380 8/2002
JP 2003225228 8/2003
JP 2005342862 12/2005
JP 2005342873 12/2005
JP 2006123136 5/2006
JP 2007069302 3/2007
JP 2008539746 11/2008
JP 2009502179 1/2009
JP 2011517954 6/2011
JP 2012192518 10/2012
JP 2013500987 1/2013
WO 2008109433 9/2008
WO 2016034239 A1 3/2016

OTHER PUBLICATIONS

Kevin Langton, "Localization of the Functional Domains of Human Tissue Inhibitor of Metalloproteinases-3 and the Effects of a Sorsby's Fundus Dystrophy Mutation", J. Biol. Chem., 1998, vol. 273, No. 27, p. 16778-16781.
Eri Ishikawa, "Analysis of gaze mimicking effect by Gaze Mirroring", Human Interface 2011 papers, JP, (Sep. 13, 2011), pp. 61-566.
International Search Report dated Oct. 4, 2016, issued in International Application No. PCT/US16/41605 filed Jul. 8, 2016, inventor Roberts, Kimberly et al.

* cited by examiner

SYSTEM AND METHOD FOR DISPENSING A BEVERAGE

CROSS-REFERENCE TO RELATED APPLICATIONS

This application claims the benefit of U.S. Provisional Application No. 62/191,201, filed Jul. 10, 2015, which is herein incorporated by reference in its entirety.

BACKGROUND

Current consumer perception is that good wine only comes in bottles. Because of this, bars and restaurants have served wine by the glass by opening and resealing individual bottles. Wine waste goes up and the pours of wine are not as fresh as the first pour. However, with wines on tap at a bar or restaurant, the aging process does not occur in the keg because the wine is blanketed with a gas such as nitrogen or argon to pressurize the keg. This works in the favor of consumers when they get a fresh pour every time with wine on tap at a bar or restaurant.

Wine on tap also creates other cost savings by eliminating bottle, cork, and carton. Transport costs are significantly reduced without heavy glass, plus steel kegs are disposable and recyclable. However, there is currently no consistent way for consumers to enjoy wine on tap in their homes without having a system to store a wine keg.

Thus, what is needed is a system and method that allows consumers to conveniently enjoy wine on tap in their homes.

SUMMARY

Briefly and in general terms, various embodiments are directed to a system for dispensing a beverage. The system includes a beverage cartridge storing a liquid and having a spout that dispenses the stored liquid. A beverage press includes a housing that receives the beverage cartridge, a tap that engages the spout of the beverage cartridge, and a lifting assembly that exerts force on the beverage cartridge. Once the beverage cartridge is secured within the beverage press, a user may press the tap to activate the spout of the beverage cartridge in order to dispense the stored liquid through the spout and out of the tap of the beverage press. Any liquid, such as wine, beer, water, juice, soda, any alcoholic or non-alcoholic liquid, may be stored in the beverage cartridge. In certain embodiments, the liquid may be dispensed through the spout without insertion of the beverage cartridge into the beverage press.

Various other embodiments describe a method for dispensing a liquid. The method may include inserting a beverage cartridge into a beverage press. The beverage cartridge may store any liquid and includes a spout for dispensing the stored liquid. In one embodiment, the beverage press includes a housing that receives the beverage cartridge, a tap, and a lifting assembly that exerts force on the beverage cartridge. The method further includes engaging the spout of the beverage cartridge with the tap of the beverage cartridge, and pressing the tap of the beverage press to activate the spout of the beverage cartridge and release the liquid through the spout of the beverage cartridge and the tap of the beverage press.

BRIEF DESCRIPTION OF THE DRAWINGS

The accompanying figures, which are included as part of the present specification, illustrate the various embodiments of the present disclosed system and method and together with the general description given above and the detailed description of the preferred embodiments given below serve to explain and the teach the principles of the present disclosure.

Figures 1A, 1B, 1C, 1D:
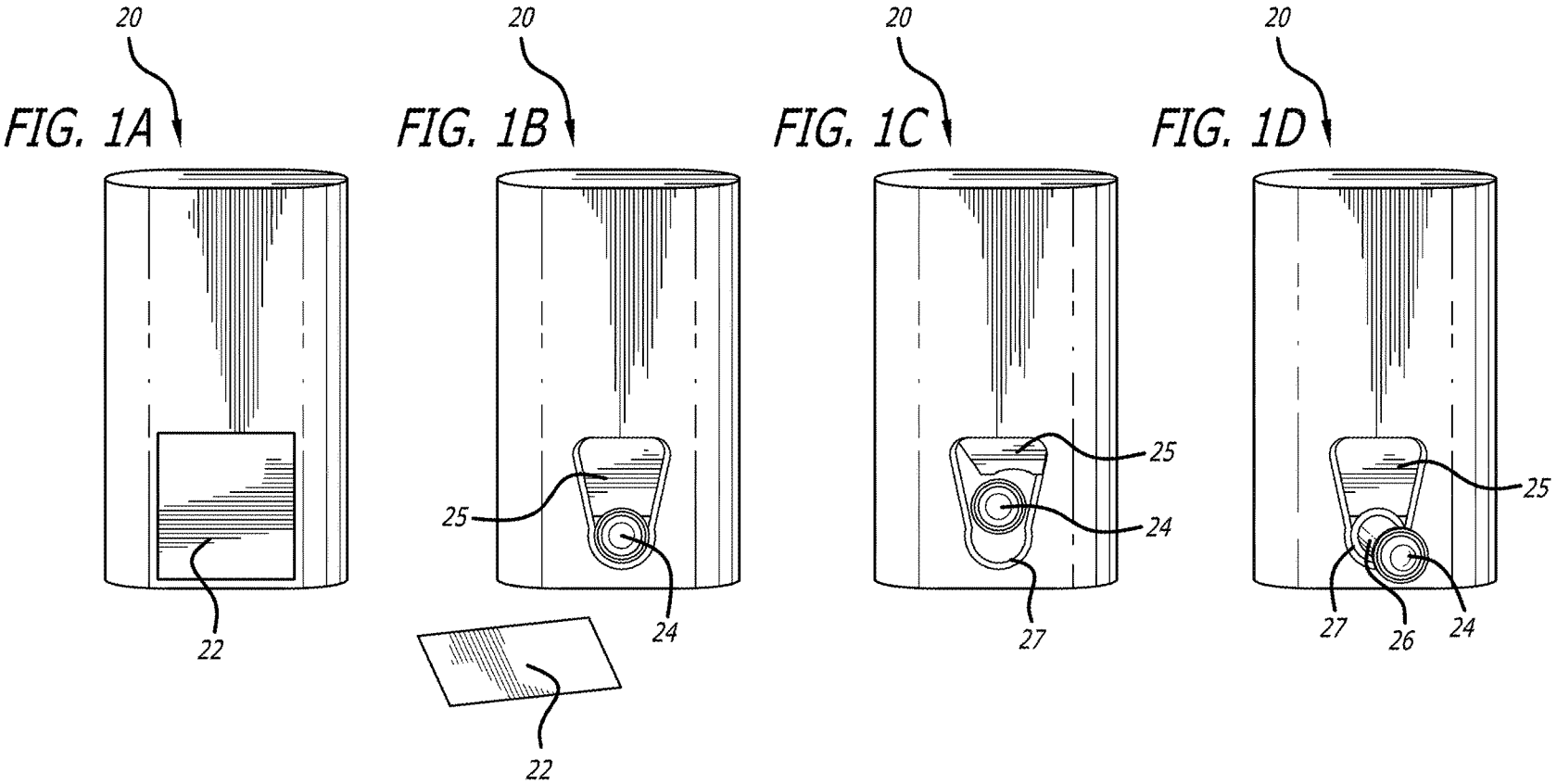
FIGS. 1A-1D illustrate one exemplary beverage cartridge.

It should be noted that the figures are not necessarily drawn to scale and elements of similar structures or functions are generally represented by like reference numerals for illustrative purposes throughout the figures. It also should be noted that the figures are only intended to facilitate the description of the various embodiments described herein. The figures do not describe every aspect of the teachings disclosed herein and do not limit the scope of the claims.

DETAILED DESCRIPTION

The present disclosure describes a system and method for dispensing a beverage (e.g., wine) on tap. The tap is a valve that controls the release of the beverage out of a dispenser. According to one embodiment, the present system dispenses a beverage from a beverage sealed in a pouch or a bag. Bag-in-box type packaging is cheaper, lighter, more environmentally friendly, and easier to transport and store than glass-bottled wine.

According to one embodiment, the present system includes a beverage cartridge that dispenses a beverage based on gravity. This may be referred to as gravity mode. The present system may further include a beverage press that allows the beverage cartridge to be inverted and inserted into the beverage press. The beverage press compresses the beverage cartridge to dispense the beverage. This may be referred to as dispensing mode. FIG. 1 illustrates a beverage cartridge, according to one embodiment. The beverage cartridge has a height of 9.5 inches, a length of about 5.8 inches, and a width of about 3.5", according to one embodiment. The size and shape of the beverage cartridge may vary.

According to one embodiment, the present system includes a beverage cartridge that includes a spout for dispensing a beverage in a gravity mode. The spout of the beverage cartridge is in proximity to a surface that the beverage cartridge rests on, such as a countertop. This allows the spout of the beverage cartridge to dispense a beverage based on gravity. The beverage cartridge may contain any volume of beverage, for example, a volume of 1.5 liters, or a volume equivalent to a two-bottle wine box. In one embodiment, a user that holds a side radius of the beverage cartridge has a similar feeling of holding a 750 milliliter (ml) bottle. A typical 750 ml bottle has a diameter of 3 inches. A typical 0.187 ml four-pack beverage has a dimensions of 4 inches by 4 inches. A typical 1.5 liter bottle has a diameter of 4 inches.

FIGS. 1A-1D illustrate an exemplary beverage cartridge 20, according to one embodiment. In FIG. 1A, the beverage cartridge 20 includes a label 22 that covers the front of the beverage cartridge prior to dispensing a beverage. The beverage cartridge 20 further includes a spout 24 that protrudes from a door 25 of the beverage cartridge for dispensing a beverage. The spout includes a button activated valve 26 that can be pressed to dispense a beverage. During production and shipping, the label protects the spout and prevents accidental dispensing of the liquid.

Together, FIGS. 1A-1D illustrate an exemplary diagram for preparing a spout of a beverage cartridge for dispensing a beverage, according to one embodiment. A user peels back the label 22 on the front of the beverage cartridge to reveal the spout 24 and the door 25 that are contained within a cavity in the beverage cartridge 20. The cavity may be shaped to conform to the sides of the spout and the door. In this embodiment, the door is flush with the spout. The spout is engaged with an opening 27 of a beverage bag within the beverage cartridge to seal the beverage bag. The opening of the beverage bag may include one or more grooves, according to one embodiment. The user may further lift the door 25 by pulling the door away from the beverage cartridge. The user lifts the spout 24 up and away from the beverage cartridge and seats the spout in the cavity such that the spout is protruding from the beverage cartridge. After the user seats the spout, the user returns the door 25 to lock by lowering the door towards the beverage cartridge and engaging an edge of the door with a groove in the opening of the beverage bag.

Figure 2:
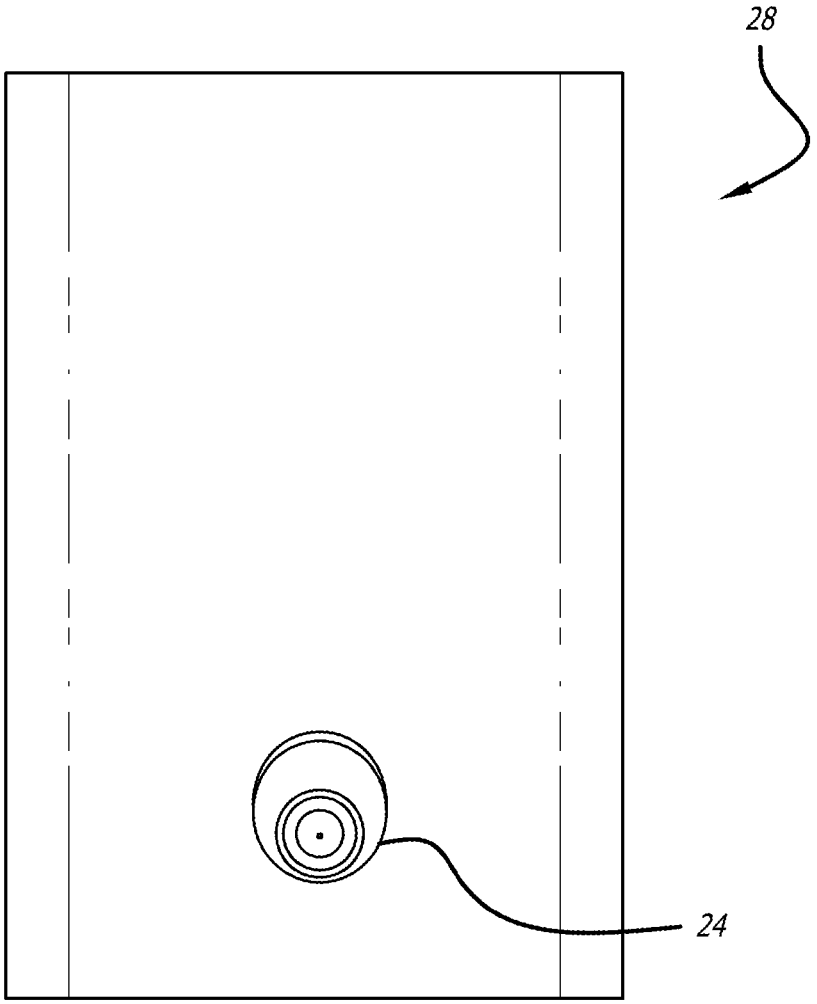
FIG. 2 depicts a front view of a beverage bag used inside a beverage cartridge.

FIG. 2 illustrates a front view of a beverage bag 28 used inside a beverage cartridge 20, according to one embodiment. The beverage bag may include a volume of 1.5 liters of beverage, according to one embodiment. However, the beverage bag may be sized to hold any amount of a liquid. The beverage bag may be pre-filled with a beverage using a filling system. The beverage bag opening may be sealed by engaging a spout with the beverage bag opening.

Figure 3:
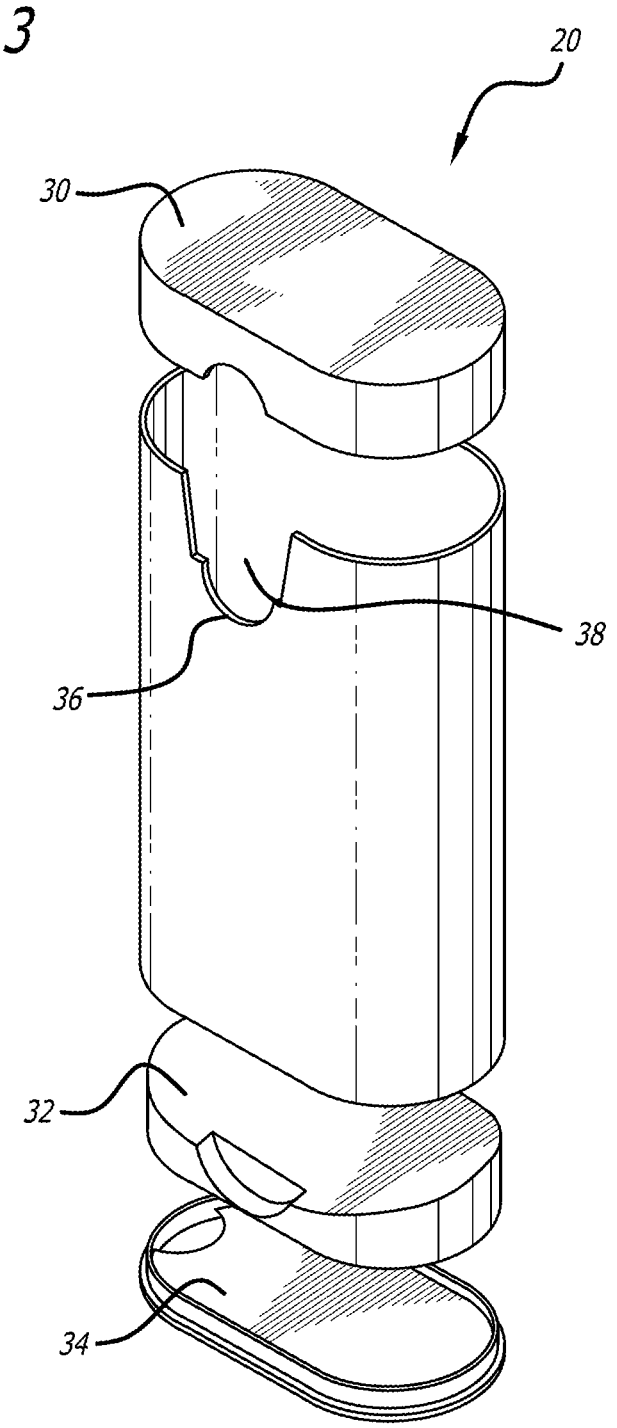
FIG. 3 depicts an exploded view of one embodiment of a beverage cartridge.

FIG. 3 illustrates exemplary components of the beverage cartridge 20, according to one embodiment. The beverage cartridge includes a canister top cap 30, a canister floor 32, and a canister rim 34 that may be manufactured using an injection molding process and made of high-density polyethylene (HDPE), according to one embodiment. In other embodiments the parts of the beverage cartridge may be made from other materials, including any plastic, metal, cardboard or wood. The beverage cartridge includes a canister cardboard 36 that may be manufactured using an extrusion or winding process and made of extruded chipboard, according to one embodiment. The canister cardboard includes a recess 38 for accommodating the spout 24 of the bag 28 of beverage. The beverage cartridge 20 may also include a top label, a bottom label, a front label, and a back label that may be printed on paper.

Figure 4:
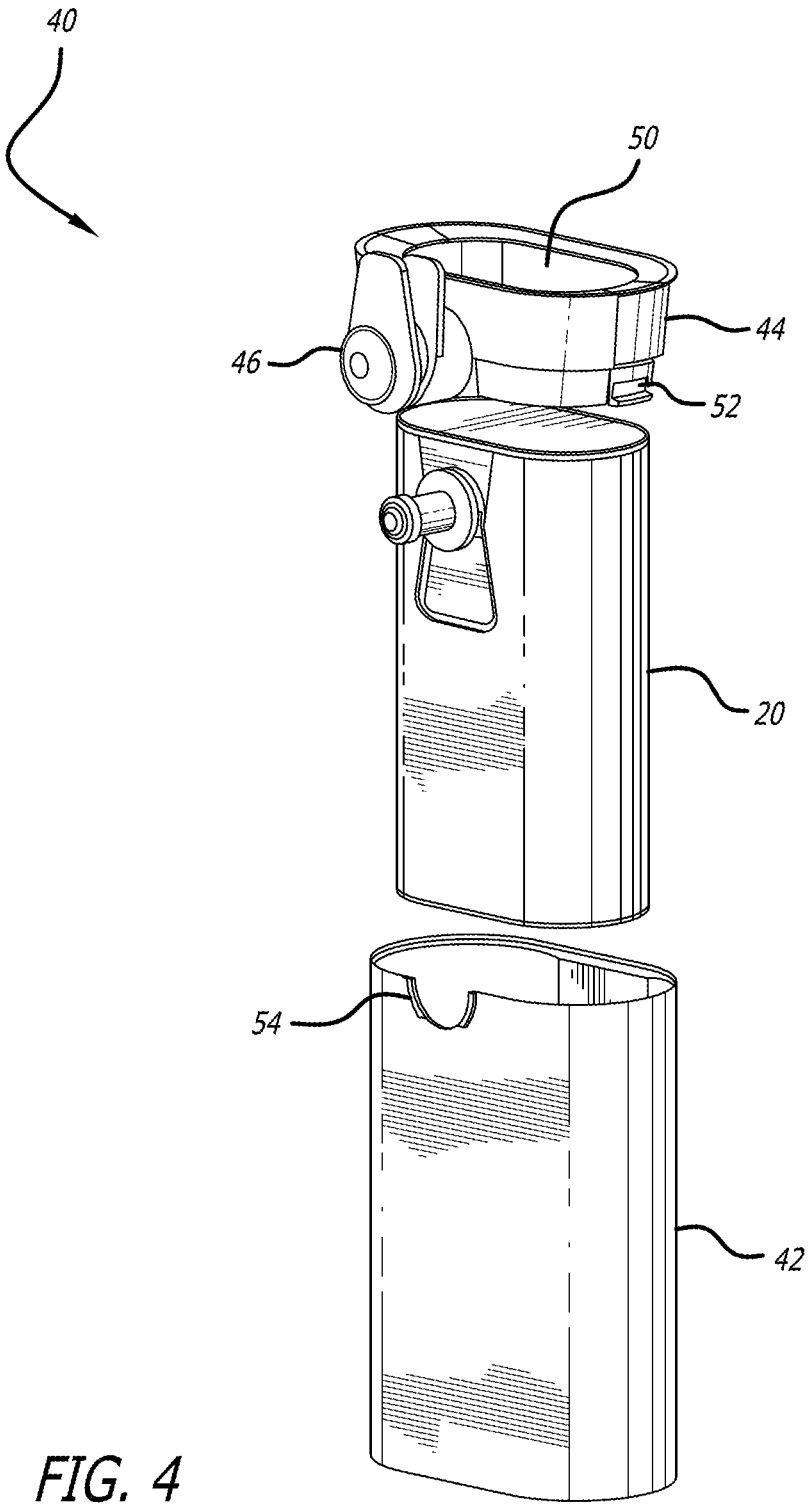
FIG. 4 depicts an exemplary diagram of a system having a beverage cartridge in a beverage press.

FIG. 4 illustrates an exemplary diagram for dispensing a beverage using a beverage press 40, according to one embodiment. As shown, the beverage press 40 includes a housing 42 and a lid 44 that includes a tap 46. A user may invert and insert a beverage cartridge 20 into the beverage press 40 for dispensing a beverage in a dispensing mode. For example, the beverage press may dispense wine into a wine glass. The beverage cartridge 20 is inverted such that the spout 24 of the beverage cartridge is on an opposing end to a base of the beverage press 40. The beverage press 40 includes a lifting mechanism such as a spring mechanism (see FIG. 9) for lifting and dispensing a beverage from the beverage cartridge. In one embodiment, the beverage press fits a standard 9-inch wine glass under the tap of the beverage press. It is understood that the beverage press may dispense a beverage into a vessel of any height without deviating from the scope of the present disclosure.

Figure 5:
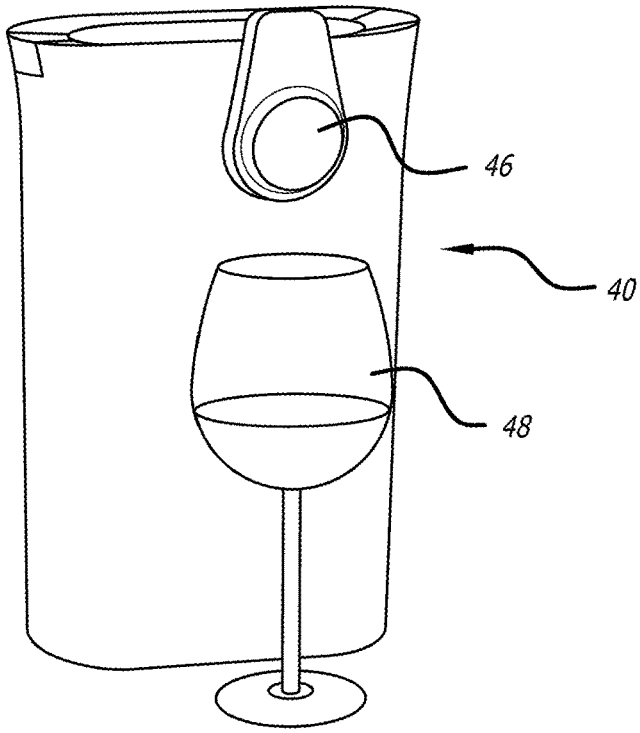
FIG. 5 depicts a wine glass stationed under a tap of a beverage press.

The tap 46 of the beverage press 40 dispenses a beverage into a desired vessel. A user may place a vessel 48 below the tap of the beverage press such that an opening of the vessel faces the bottom of the tap as shown in FIG. 5. When the user presses one end of the tap 46, the tap dispenses a beverage into the vessel. The beverage press dispenses beverage on a surface, for example, on a countertop, on a refrigerator shelf, and within a refrigerator door shelf bin. The beverage press may have a tapered body that allows a user to hold and transport the beverage press without the beverage press slipping from his/her hand. Ridges, indentations, or other structures for gripping may be added to the body of the beverage press.

According to one embodiment, the shape of the tap mimics the silhouette of a wine glass. It is understood that the tap may be of any shape without deviating from the scope of the present disclosure. The tap may be made of stamped aluminum cover, according to one embodiment. However, any material, such as plastic may be used. The tap includes a curved handle to allow a user to conveniently place his/her finger on the tap. The tap may further include a front face that provides an engraved logo and reflects light.

FIG. 4 illustrates an exploded view of a beverage cartridge and beverage press assembly, according to one embodiment. A user may place the lid 44 of the beverage press 40 over the top of the beverage cartridge 20 and push down on the beverage cartridge towards the base of the beverage press until the lid of the beverage press engages the housing 42 of the beverage press. The lid of the beverage press may include a cutout 50 to expose the top of the beverage cartridge and show a label printed on or attached to the top of the beverage cartridge. The lid 44 may include tabs 52 that may rest within grooves on the inside of the housing of the beverage press to lock the lid in place. The lid may also be unlocked and removed from the housing of the beverage press 42 by pressing the tabs and pulling up on the lid to disengage the tabs 52.

Figure 6:
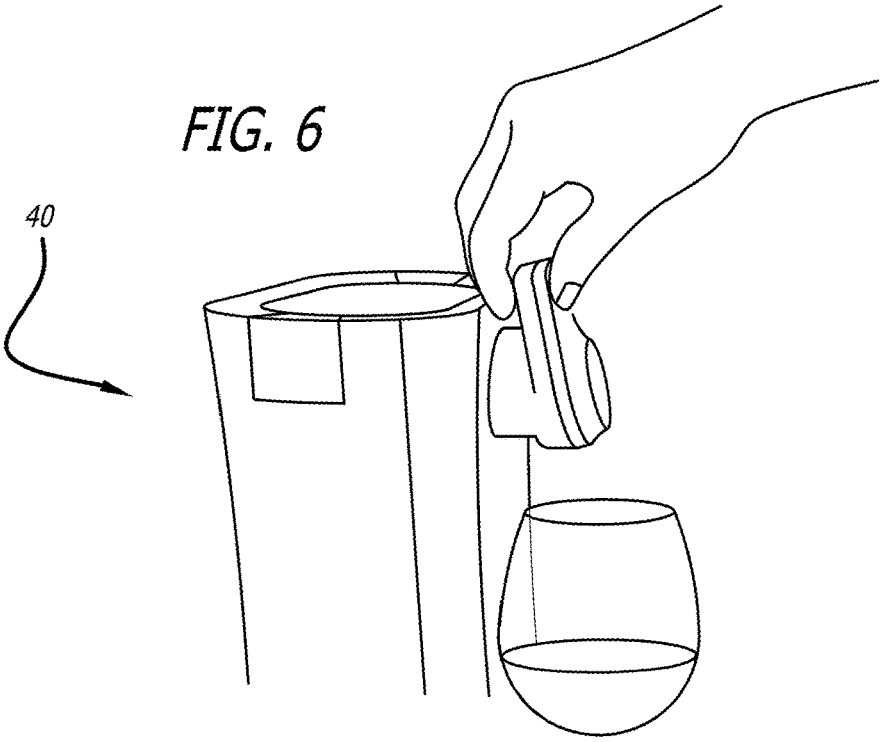
FIG. 6 depicts an exemplary diagram for dispensing wine from a beverage press into a wine glass.

FIG. 6 illustrates an exemplary diagram for dispensing a beverage from the beverage press 40, according to one embodiment. A user presses his/her finger or thumb on one end of the tap 46 to compress a button activated valve 26 of the spout 24 on the beverage cartridge 20 inserted into the beverage dispenser to release a beverage from the beverage cartridge into a vessel.

Figure 7:
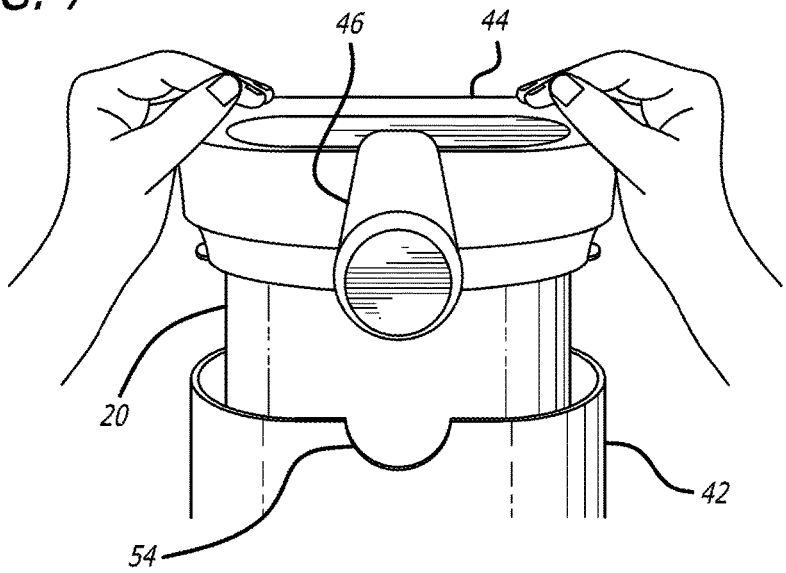
FIG. 7 depicts an exemplary diagram for loading a beverage cartridge into a beverage press.

FIG. 7 illustrates an exemplary diagram for loading a beverage cartridge 20 into a beverage press 40, according to one embodiment. A user loads the beverage cartridge 20 into the beverage press 40 by inverting and inserting the beverage cartridge into the beverage press. The user inverts the beverage cartridge such that the spout of the beverage cartridge is in proximity to a cavity 54 in the housing 42 of the beverage press 40. The user attaches the lid 44 of the beverage press to a top end (the end having the spout) of the beverage cartridge housing 42 such that the tap 46 on the lid of the beverage press engages to the spout 24 of the beverage cartridge. According to one embodiment, the tap 46 on the lid 44 of the beverage press 40 touches or leans against the spout 24 of the beverage cartridge 20. The user pushes down on the beverage cartridge 20 towards the base of the beverage press 40 using the lid 44 of the beverage press until the lid of the beverage press engages with the beverage press. In one embodiment, the beverage press provides an indication that the beverage cartridge is loaded into the beverage press by providing a feedback sound (e.g., a click sound) once the tabs 52 engage the housing 42 of the beverage press.

Figure 8:
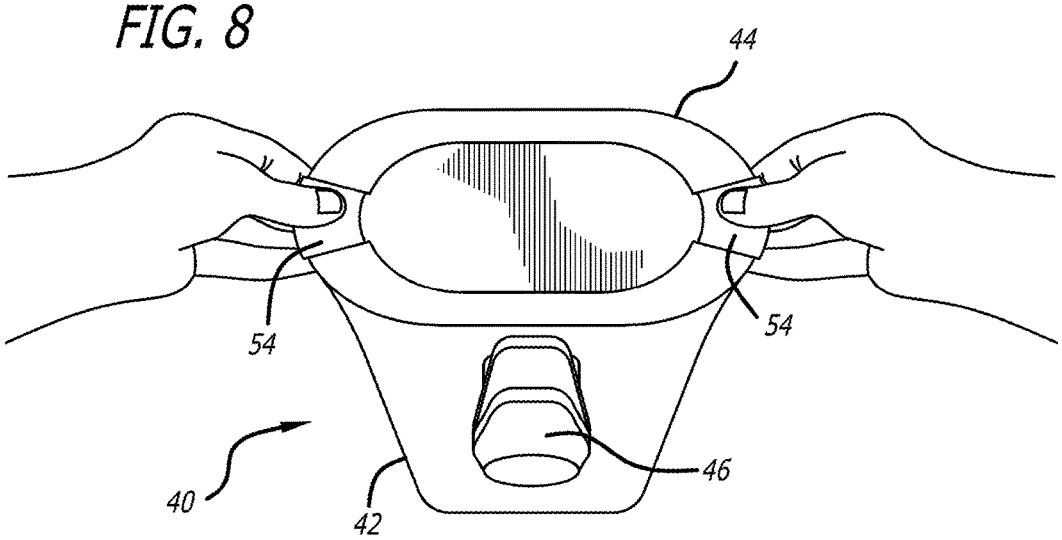
FIG. 8 depicts an exemplary diagram for removing the lid of the beverage press.

FIG. 8 illustrates an exemplary diagram for removing the lid 44 of a beverage press 40, according to one embodiment. The beverage press 40 includes side buttons 54 that are located on both ends of the lid. The side buttons 54 may be pulled away from each other to disengage the tabs 52 from the housing 42 to release the lid 44 from the beverage press housing.

Figure 9A:
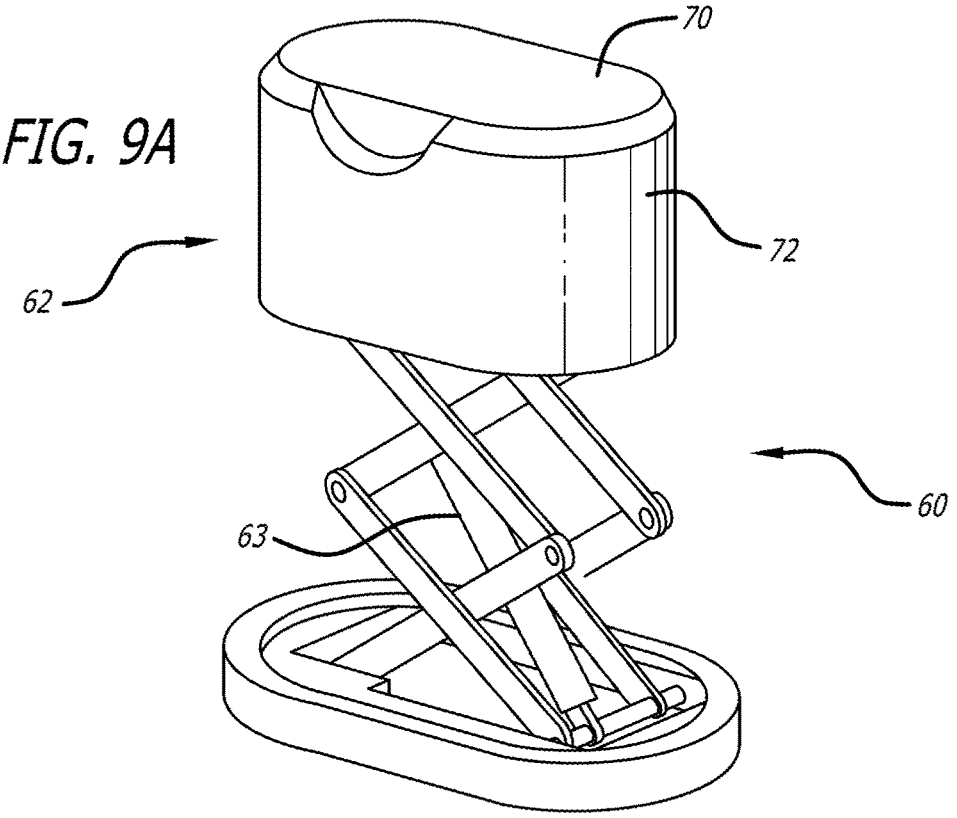
FIGS. 9A and 9B depict an exemplary embodiment of a lifting mechanism.
Figure 9B:
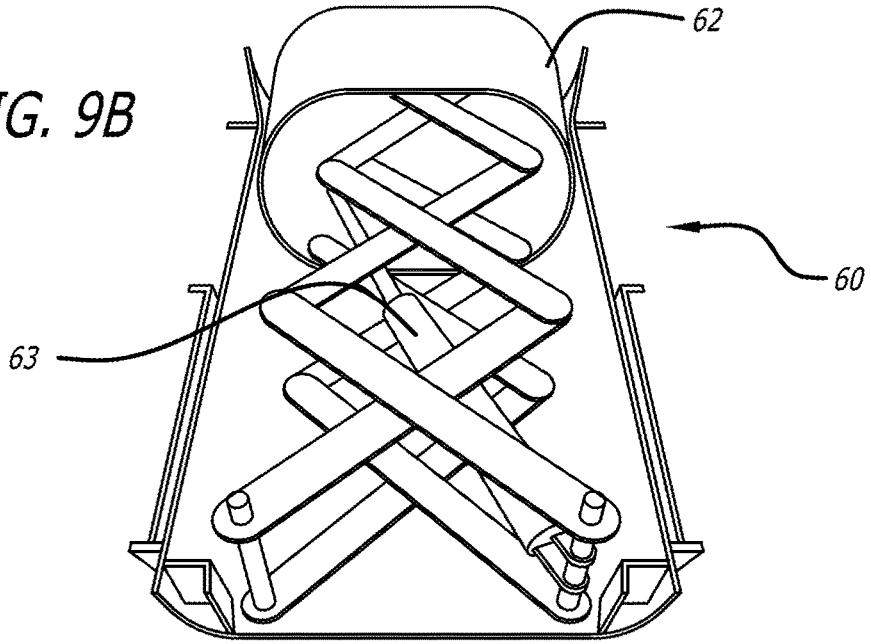
Figure 10:
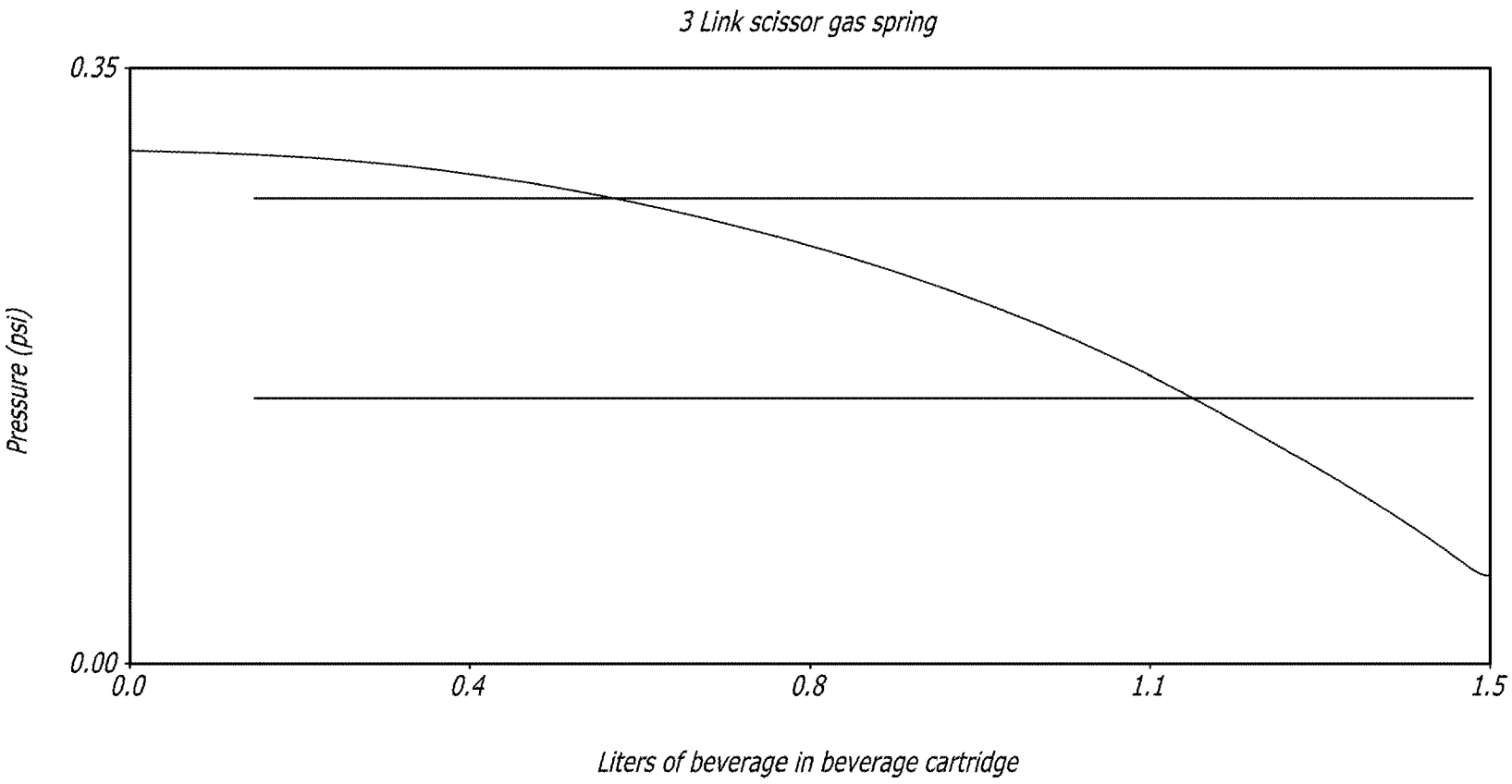
FIG. 10 depicts an exemplary plot of the pressure exerted by a three link scissor gas spring for a volume of beverage in a beverage cartridge.

FIGS. 9A-9B illustrate an exemplary dispensing mechanism or lifting assembly 60 within a beverage press 40, according to one embodiment. The beverage press 40 includes a dispensing mechanism 60 that is a scissor mechanism for providing a consistent flow during beverage dispensing. The scissor mechanism includes a piston 62 attended to one end of the scissor spring that is aligned for straight travel in the beverage press. The scissor mechanism or spring further includes a gas spring 63 that provides integrated damping to slow the movement of the scissor springs and piston. FIG. 10 illustrates an exemplary plot of the pressure of a scissor gas spring for a volume of beverage in a beverage cartridge, according to one embodiment. A beverage cartridge 20 filled with beverage is inverted and inserted into a beverage press 40 such that a scissor gas spring within the beverage press is compressed. The plot of FIG. 10 shows that the pressure of a scissor gas spring within a beverage press decreases when the volume of beverage remaining in a beverage cartridge decreases.

Figure 11:
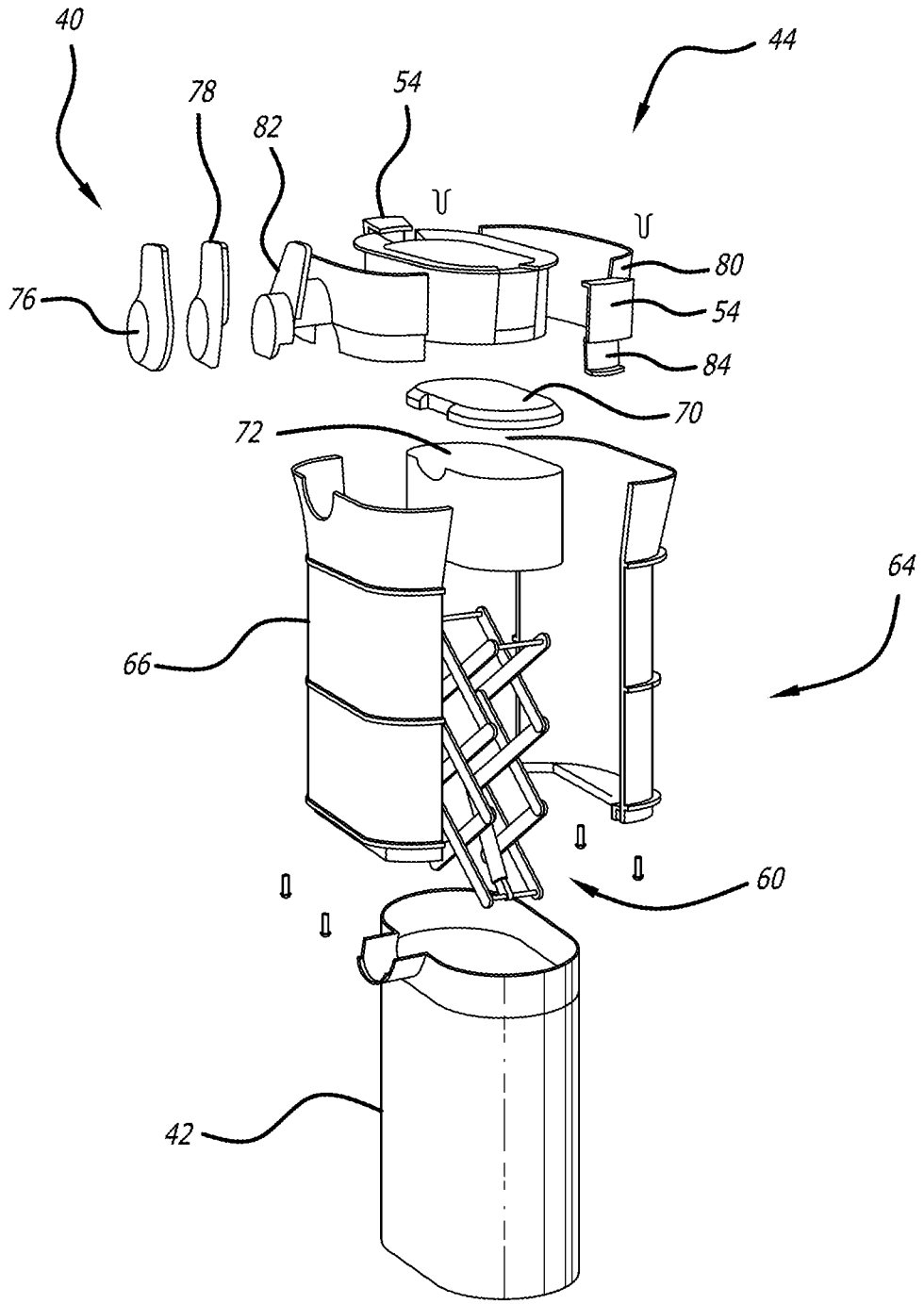
FIG. 11 depicts an exploded view of an exemplary beverage press.

FIG. 11 illustrates an exploded view of an exemplary beverage press 40, according to one embodiment. The beverage press 40 includes a body 64, a scissor mechanism 60, and a lid 44. The body of the beverage press 40 includes a housing 42, a front shell 66, and a back shell 68 that may be manufactured using an injection molding process and made of acrylonitrile butadiene styrene (ABS). The body 64 of the beverage press 40 further includes four screws that may be made of steel.

The scissor mechanism 60 of the beverage press includes an upper piston 70 and a lower piston 72 that may be manufactured using an injection molding process and made of ABS. In one embodiment, the scissor mechanism 60 includes tubular rivets, washers, and stamped links that may be made of plated steel. The scissor mechanism includes machined slider pins that may be made of stainless steel, and machined short pins and clips that may be made of stainless steel. The scissor mechanism may further include spacers made of plastic tubing.

The lid 44 of the beverage press 40 includes a tap shell 76, a tap body 78, a back lid shell 80, a front lid shell 82, a core lid 84, and two buttons 54 that may be manufactured using an injection molding process and made of ABS. In one embodiment, the lid includes a tap spring, two button springs, and a tap pivot pin that may be made of stainless steel. The tap pivot pin may have dimensions of 2 mm×12 mm.

Figure 12:
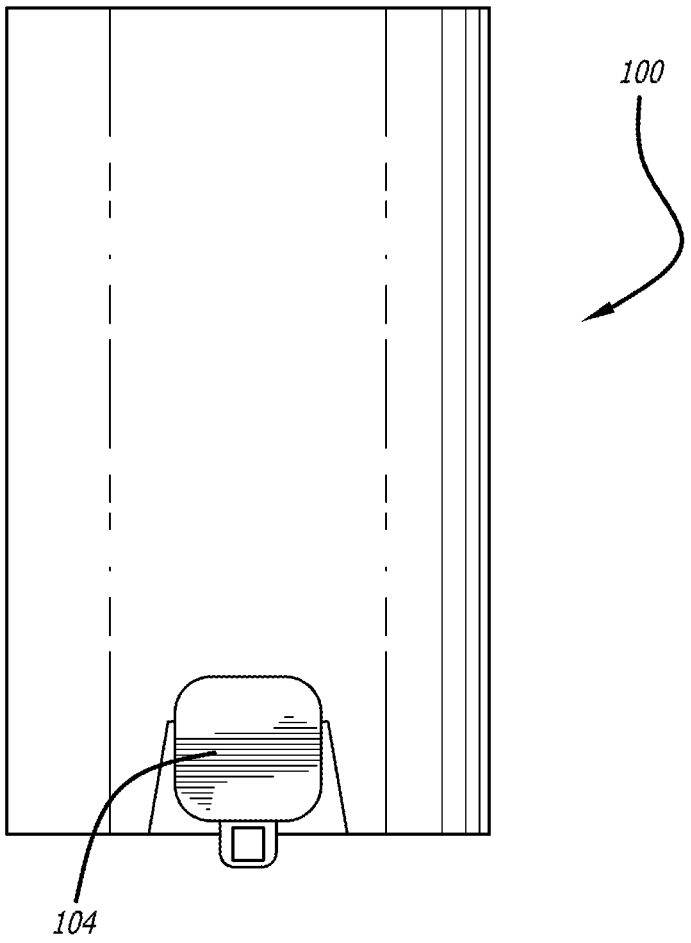
FIG. 12 depicts an exemplary beverage cartridge with a spout cap covering a spout.

FIG. 12 illustrates an exemplary beverage cartridge 100 with a protruding spout 102 (FIG. 13), according to one embodiment. The protruding spout allows a desired ring location with grooves for use in the dispenser mode. The protruding spout further provides a secure spout in the gravity mode. The beverage cartridge may further include a spout cap 104 for covering and protecting the protruding spout during transportation by engaging the spout cap with the spout. The spout cap 104 may further be used to twist the spout in the dispenser mode.

Figure 13C:
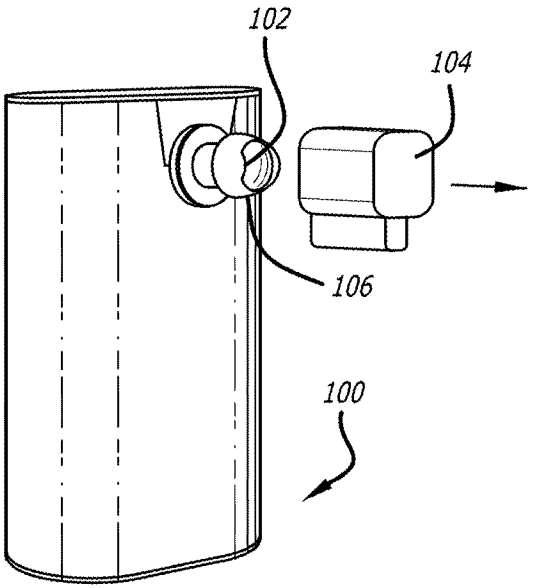
FIGS. 13A-13C depict exemplary uses of the beverage cartridge depicted in FIG. 12.
Figure 13B:
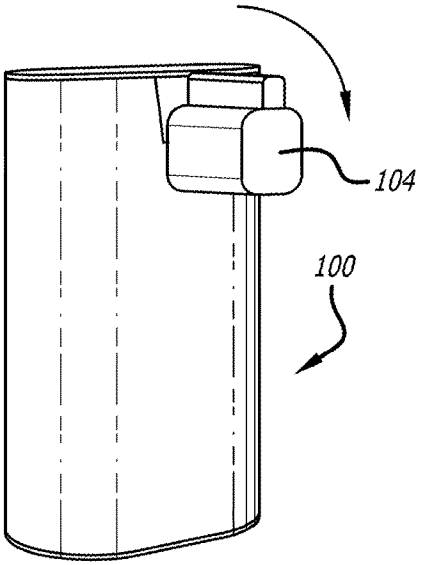
Figure 13A:
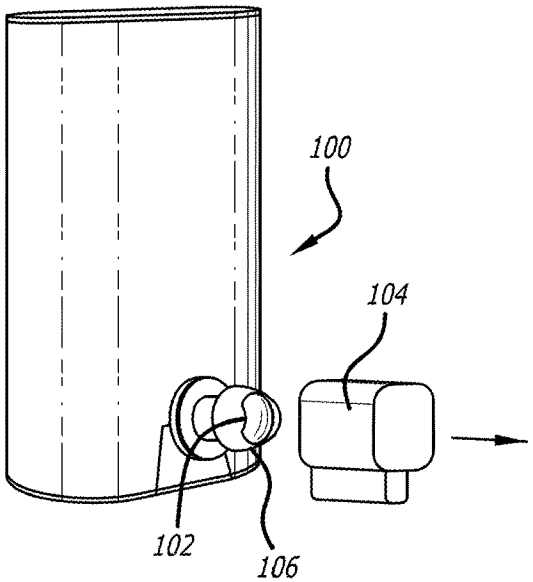

FIGS. 13A-13C illustrate exemplary uses of a spout of a beverage cartridge, according to one embodiment. In the gravity mode, a user may remove the spout cap 104 from the spout 102 of the beverage cartridge. The spout includes a spout opening 106 that faces downwards as shown in FIG. 13A. The user may then dispense a beverage from the spout based on gravity.

Referring to FIGS. 13B-13C, in the dispenser mode, the user may invert the beverage cartridge 100 and use the spout cap 104 to twist the spout 102 for use with a beverage press 40. The user may rotate the spout cap 180 degrees to similarly twist and rotate the spout 180 degrees. This allows the spout opening 106 to rotate and face downwards when the beverage cartridge is inverted. The user removes the spout cap 104 from the spout 102 and loads the beverage cartridge into the beverage press 40.

Figure 14A:
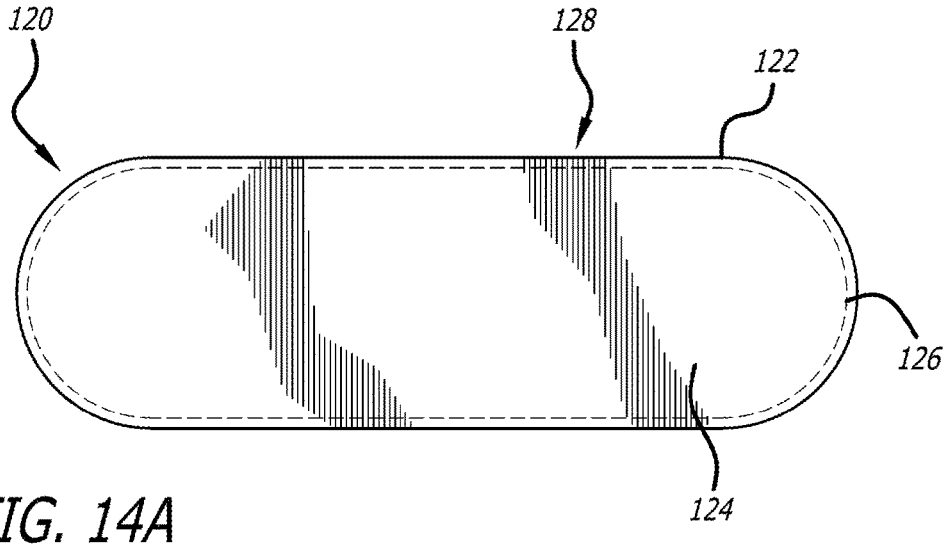
FIGS. 14A and 14B depict one example of a beverage cartridge having a breakaway floating floor design.
Figure 14B:
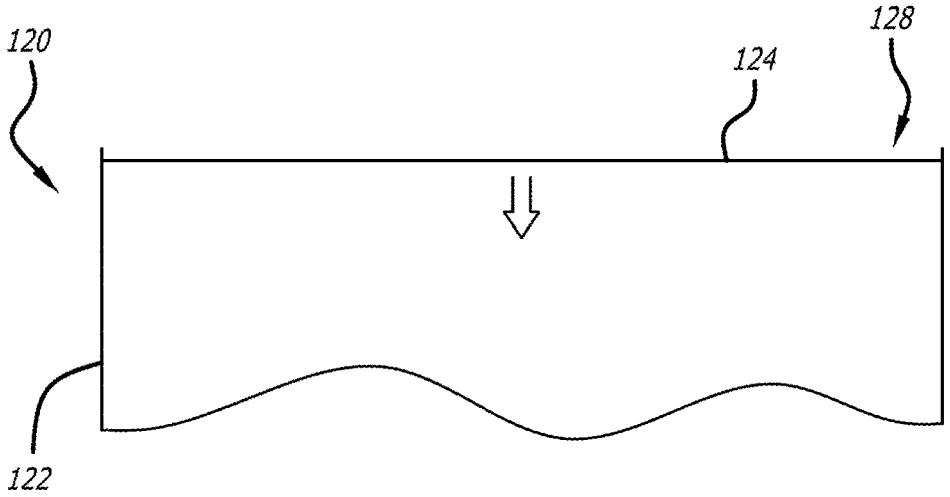

Another embodiment of a beverage cartridge 20 is shown in FIGS. 14A and 14B. FIG. 14A shows a bottom plan view of a canister box 122 having a breakaway floating floor 124. The breakaway floating floor 124 is defined by a perforated breakaway edge 126. The breakaway floating floor 124 allows an end 128 of the box 122 to be held in a fixed position during production, shipping, and retail shelving of the product.

Once the perforated breakaway edge 126 is broken, the breakaway floating floor 124 has freedom of movement into the box 122, while still being constrained against movement out of the box as shown in FIG. 14B. In one embodiment, a canister rim or cover, such as the canister rim 34 shown in FIG. 3 would be placed over the bottom end 128 of the box 122 to protect the perforated breakaway edge 126 of the breakaway floating floor 124 from breaking during production, shipping or retail. It has also been contemplated that the beverage cartridge 20 of previously described embodiments also may include a bottom end having a breakaway floating floor defined by a perforated edge. Any embodiment of the beverage cartridge may be installed and used in the disclosed beverage press 40.

Figure 15B:
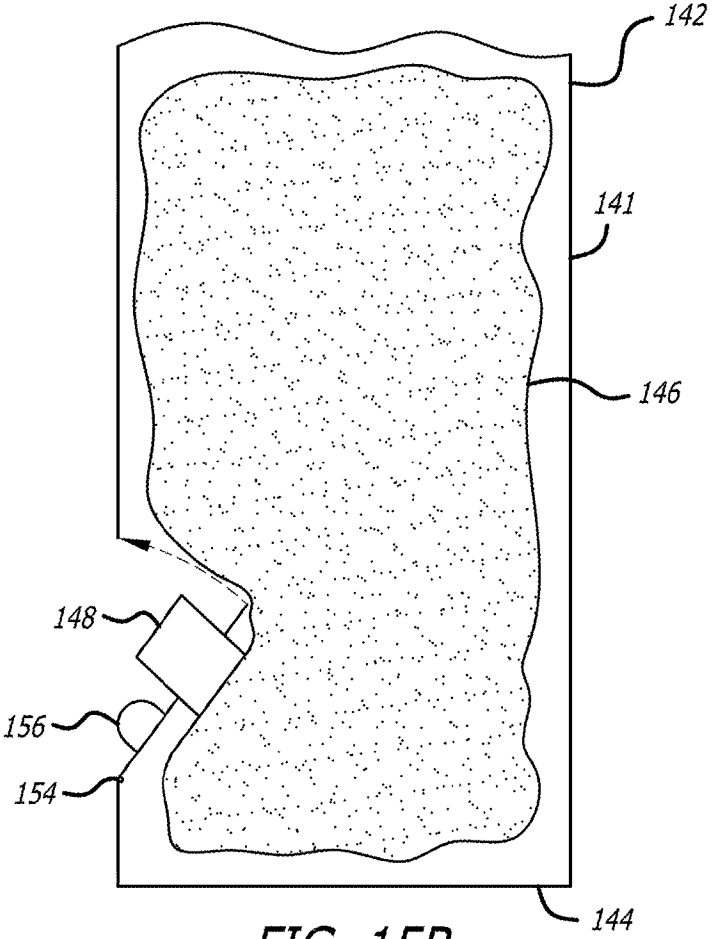
FIGS. 15A and 15B depict another example of a beverage cartridge having a tap or spout locator.
Figure 15A:
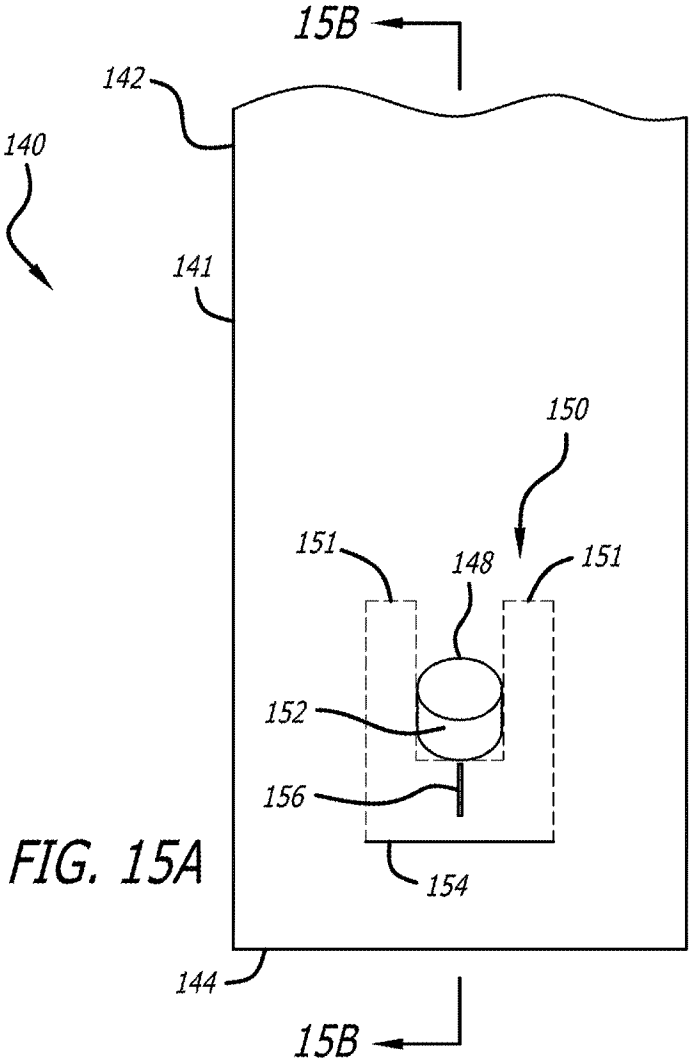

Yet another embodiment of a beverage cartridge 140 is shown in FIGS. 15A and 15B. FIG. 15A shows a beverage cartridge 140 having a canister box 141 with a first end 142 and a second 144. During production, the first end 142 is left open to load a liquid bag 146. The liquid bag 146 includes a spout 148 that seals an opening of the bag. To secure and protect the spout 148, the spout is seated into a tap locator 150 of the beverage cartridge box 141. The tap locator 150 includes fingers 151 forming a seating area 152 that engages the neck of the bag spout 148. As best shown in FIG. 15B, the tap locator 150 includes a hinge 154 connected to the box 141 that allows the tap locator 150 to pivot inside the box 141, and flush with the box. When a bag 146 is loaded into the box 141, the neck of the spout drops into the seating area 152 of the tap locator 150.

In one embodiment, the tap locator 150 includes a pull tab 156 located above the hinge 154. A user may grab the pull tab 156 to pivot the tab locator and pull the spout 148 out of the box 141. In other embodiments, the pull tab may be located above the seated spout 148 or no pull tab may be necessary. Any of the other previously described embodiments of a beverage cartridge may incorporate the features shown in FIGS. 15A and 15B.

In one embodiment, the bag-in-box wine tap locator cartridge 140 allows a wine spout 148 to automatically be held in a fixed position within the box 141 during production. The fixed position protects the spout 148 during production, shipping, and retail shelving of the product. To prepare the product for consumption, the bag-in-box wine tap locator cartridge allows the wine spout 148 to be conveniently brought out of the box 141 by pulling on a pull tab 156, without the end user having to dig around inside the box in search of the tap.

The above example embodiments have been described hereinabove to illustrate various embodiments of implementing a system and method for dispensing a beverage. Various modifications and departures from the disclosed example embodiments will occur to those having ordinary skill in the art.

What is claimed:

1. A system for dispensing a beverage, comprising:

a beverage cartridge storing a liquid and having a spout that dispenses the stored liquid;

a beverage bag within the beverage cartridge, wherein the beverage bag contains the stored liquid; and a beverage press including a housing that receives the beverage cartridge, a lid having a tap that engages a button activated valve of the spout of the beverage cartridge, and a beverage bag lifting assembly, wherein the tap activates the button activated valve of the spout of the beverage cartridge to dispense the stored liquid through the spout and out of the tap of the beverage press.

2. The system of claim 1, wherein the beverage cartridge includes a removable label that covers the spout.

3. The system of claim 2, wherein the beverage cartridge includes a cavity and the spout of the beverage cartridge is stored within the cavity when the removable label is on the beverage cartridge.

4. The system of claim 3, wherein the spout of the beverage cartridge extends out from the beverage cartridge after removing the removable label.

5. The system of claim 1, wherein the spout of the beverage cartridge is engaged with an opening of the beverage bag.

6. The system of claim 5, wherein the beverage cartridge includes a tap locator that receives the spout that is engaged with an opening of the beverage bag.

7. The system of claim 6, wherein the tap locator is hinged on the beverage cartridge and moves the spout from within the beverage cartridge to outside of the beverage cartridge.

8. The system of claim 1, wherein the beverage cartridge includes a canister box having a recess to accommodate the spout of the beverage cartridge, and the canister box having a top end and a bottom end.

9. The system of claim 8, wherein the beverage cartridge includes a top cap that connects to the top end of the canister box, a canister floor that connects to the bottom end of the canister box, and a canister rim that connects to the canister floor.

10. The system of claim 1, wherein the beverage cartridge includes a box having a first end and a second end, the first end of the box includes having a breakaway floor, and when the lift assembly exerts force on the beverage cartridge, the breakaway floor disengages from the box.

11. The system of claim 1, wherein the beverage bag lifting assembly of the cartridge press is a scissor assembly.

12. The system of claim 11, wherein the beverage bag lifting assembly includes a piston attached to the scissor assembly and a gas spring that slows the movement of the piston being forced upward by the scissor assembly, and the piston pushes against and lifts a portion of the beverage cartridge toward the spout to dispense the stored liquid through the spout.

13. The system of claim 1, wherein the beverage press has a height to accommodate a glass to sit under the tap when the beverage press is resting on a surface.

14. The system of claim 1, further comprising a spout cap that is removably engaged with the spout of the beverage cartridge.

* * * * *